US008852069B2

(12) United States Patent
Haruki et al.

(10) Patent No.: US 8,852,069 B2
(45) Date of Patent: Oct. 7, 2014

(54) CENTRIFUGE WITH VACUUM PUMP CONFIGURED OF AUXILIARY VACUUM PUMP AND OIL DIFFUSION PUMP

(71) Applicant: Hitachi Koki Co., Ltd., Tokyo (JP)

(72) Inventors: Shinichi Haruki, Hitachinaka (JP); Hiroyuki Takahashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 13/739,935

(22) Filed: Jan. 11, 2013

(65) Prior Publication Data

US 2013/0184140 A1 Jul. 18, 2013

(30) Foreign Application Priority Data

Jan. 18, 2012 (JP) ..... 2012-008348

(51) Int. Cl.
*B04B 13/00* (2006.01)
*B04B 15/02* (2006.01)
*B04B 15/08* (2006.01)

(52) U.S. Cl.
USPC ..... 494/1; 494/10; 494/13; 494/61

(58) Field of Classification Search
USPC ..... 494/1, 10–16, 23–30, 35, 38–39, 42, 494/43, 61, 85
See application file for complete search history.

(56) References Cited

U.S. PATENT DOCUMENTS 3,327,938 A * 6/1967 Hans Stallmann ..... 494/15
4,941,866 A * 7/1990 Gorodissky et al. ..... 494/14
8,038,592 B2 * 10/2011 Toi et al. ..... 494/2
8,409,068 B2 * 4/2013 Akatsu et al. ..... 494/1
8,529,424 B2 * 9/2013 Takahashi ..... 494/7
2011/0021332 A1 * 1/2011 Akatsu et al. ..... 494/1
2011/0059835 A1 * 3/2011 Takahashi ..... 494/10
2011/0207590 A1 * 8/2011 Ooyama et al. ..... 494/9
2013/0184140 A1 * 7/2013 Haruki et al. ..... 494/7

FOREIGN PATENT DOCUMENTS

JP 2001-104826 A 4/2001
JP 2001104826 A * 4/2001 ..... B04B 7/06
JP 2008-023477 A 2/2008
JP 2009195875 A * 9/2009
JP 2010104944 A * 5/2010
JP 2010-131560 * 6/2010
JP 2011-025176 A 2/2011
JP 2011230085 A * 11/2011
JP 2013146667 A * 8/2013

* cited by examiner

*Primary Examiner* — Charles Cooley
(74) *Attorney, Agent, or Firm* — McDermott Will & Emery LLP

(57) ABSTRACT

A centrifuge includes a vacuum pump machine configured of an auxiliary vacuum pump and an oil diffusion pump for exhausting gas inside a rotary chamber to outside, in which a rotor rotates at high speed. In the centrifuge, a thermistor for detecting a temperature of oil and an oil surface inside a boiler of the oil diffusion pump is provided inside the boiler, and power of a heater is adjusted with the temperature detected by the thermistor, so that a degree of vacuum inside the rotary chamber is stably reduced from atmospheric pressure to a high vacuum state. Besides, when the heater does not heat, a current is carried through the thermistor for self-heating, and it is determined from variation in a resistance value whether the oil exists or not at a position at which the thermistor 8 is placed.

5 Claims, 5 Drawing Sheets

CENTRIFUGE WITH VACUUM PUMP CONFIGURED OF AUXILIARY VACUUM PUMP AND OIL DIFFUSION PUMP

CROSS-REFERENCE TO RELATED APPLICATION

The present application claims priority from Japanese Patent Application No. 2012-008348 filed on Jan. 18, 2012, the content of which is hereby incorporated by reference into this application.

TECHNICAL FIELD OF THE INVENTION

The present invention relates to a centrifuge having an oil diffusion pump for maintaining high vacuum in a rotary chamber in which a rotor rotates at high speed.

BACKGROUND OF THE INVENTION

A centrifuge has: a rotor for holding a test sample stored in a tube or others; and a rotary chamber (a rotor chamber) in which the rotor is placed. When the rotor is rotated at high speed by a driving device configured of an electric-powered motor or others, the test sample held by the rotor is centrifuged. A pressure in the rotary chamber (the rotor chamber) is reduced in order to prevent temperature increase of the rotor caused by windage loss.

Generally, as disclosed in Patent Document 3 (Japanese Patent Application Laid-Open Publication No. 2008-23477), in order to prevent temperature increase of the rotor and the test sample caused by frictional heat (windage loss) between air in the rotary chamber and the rotor, a so-called ultra centrifuge having a rotor with the number of revolutions of exceeding 40,000 includes: a vacuum pump machine for reducing the pressure inside the rotary chamber to a high vacuum state; and a vacuum pressure detecting unit formed of a sensor for detecting a vacuum pressure inside the rotary chamber and a sensor detection circuit.

The vacuum pump machine for reducing the pressure from atmospheric pressure to the high vacuum state includes: an auxiliary vacuum pump for reducing the pressure from the atmospheric pressure to a medium vacuum state whose pressure is about 13 pascals; and an oil diffusion pump for reducing the pressure from the medium vacuum state to the high vacuum state whose pressure is about 1 pascal. The auxiliary vacuum pump and the oil diffusion pump are connected to each other in series. The oil diffusion pump is configured of: a boiler; a heater; a jet stream generating unit; a cooling unit; an inlet; an outlet; and others. The heater heats the boiler, and the boiler heats oil stored therein. Oil molecules heated by the boiler so as to be evaporated and vaporized go up through a center part of the jet stream generating unit, and is powerfully injected downward from a peripheral part thereof. The oil molecules injected at high speed from the jet stream generating unit hit a wall surface of the cooling unit, and are cooled to be liquefied. At this time, gas molecules in periphery of the oil molecules are blown away by the oil molecules to be compressed downward. The inlet is connected to the rotary chamber, and the outlet is connected to the auxiliary vacuum pump.

In order to suppress the temperature increase of the rotor and the test sample caused by the frictional heat between the rotating rotor and the air inside the rotary chamber, a so-called vacuum standby operation in which the rotor is rotated at a predetermined certain small number of revolutions (for example, 5,000 revolutions per minute) is normally performed until the pressure inside the rotary chamber is reduced by the vacuum pump machine to a predetermined pressure (for example, the medium vacuum state whose pressure is about 13 pascals). After the pressure inside the rotary chamber becomes the medium vacuum state, a rotation rate of the rotor is accelerated to several tens of thousands or well over a hundred thousand revolutions per minute.

Alternatively, when it is desired to suppress the temperature increase of the test sample caused by the windage loss of the rotor as much as possible, a so-called vacuum start operation in which the rotor is rotated after the pressure inside the rotary chamber becomes the medium vacuum state is performed.

As disclosed in Patent Document 1 (Japanese Patent Application Laid-Open Publication No. 2001-104826) and Patent Document 2 (Japanese Patent Application Laid-Open Publication No. 2011-25176), in such a centrifuge including the vacuum pump machine, a temperature of the heater which evaporates and vaporizes diffusion oil inside the boiler of the oil diffusion pump is adjusted by the temperature sensor, so that the operation of the oil diffusion pump is controlled.

Also, as disclosed in the Patent Document 3, the operation of the oil diffusion pump is controlled based on a degree of vacuum of the rotary chamber detected by a vacuum sensor.

Further, in the oil diffusion pump used here, an amount of oil for generating the oil jet injection for the vacuuming is not normally controlled. Generally, oil is added or replaced after a necessary degree of vacuum cannot be obtained.

SUMMARY OF THE INVENTION

When the vacuum start operation is performed in the centrifuge of this type including the above-described vacuum pump machine, it takes ten or more minutes until the pressure inside the rotary chamber reaches the medium vacuum state whose pressure is about 13 pascals, and therefore, waiting time taken until the centrifuging starts is long, and operation efficiency is poor. Moreover, if the rotor is rotated for a long period of time at several tens of thousands or well over a hundred thousand revolutions per minute inside the rotary chamber under the medium vacuum state whose pressure is about 13 pascals, a temperature of the test sample is increased due to the windage loss. Therefore, when the centrifuging with a high centrifuge force is performed for a long period of time, it is required to keep the pressure inside the rotary chamber to be the high vacuum state whose pressure is about 1 pascal.

As a matter of course, on an inner wall surface of the rotary chamber serving as the rotor chamber, a cooling unit (such as a Peltier element) for keeping a temperature inside the rotary chamber at an appropriate temperature is provided. However, in the medium vacuum state, density of the air is low, and therefore, cooling by convection of the air is not performed, and the cooling relies on radiation heat. For this reason, a power of cooling the rotor, that is, a cooling power, is small, and therefore, it is required to keep the peripheral state of the rotor at the high vacuum state as much as possible so as to suppress the frictional heat (windage loss) between the air and the rotor to be low.

In order to solve these problems, it can be thought that a powerful heater for heating the oil inside the oil diffusion pump is used, and besides, for example, a cartridge heater or others capable of heating the entire periphery is used as the above-described heater so as to improve efficiency of heat transmission from the heater to the oil. By improving the efficiency of the heat transmission from the heater to the oil as described above, the time taken until the oil inside the oil diffusion pump is evaporated and vaporized can be shortened, and the time required to reduce the pressure from the atmospheric pressure to the high vacuum state can be shortened down to about half. Further, the boiler can be maintained at a high temperature so that steam is actively generated from the oil inside the oil diffusion pump, and the pressure can be maintained at the high vacuum state.

As well known, if the boiler is maintained at a high temperature, a heating amount of the boiler of the oil diffusion pump is increased, and an amount of evaporated and vaporized oil molecules injected from the jet stream generating unit is increased. Due to the increase in the amount of the oil molecules, a part of the oil molecules which has not been cooled is continuously exhausted from the outlet of the oil diffusion pump to the auxiliary vacuum pump, and therefore, an amount of oil storage inside the oil diffusion pump is decreased, and it is frequently required to supply the oil.

In order to obtain characteristics for satisfying these points, according to the Patent Document 2, a centrifuge includes: a rotary chamber; a rotor placed inside the rotary chamber; an oil diffusion pump and an auxiliary vacuum pump for reducing a pressure inside the rotary chamber; and a control device for controlling a temperature of a heater unit of the oil diffusion pump. In the centrifuge, a cartridge heater with high heating efficiency is used as a heater of the oil diffusion pump, and the control device changes the temperature of the heater unit of the oil diffusion pump from a first predetermined temperature to a second predetermined temperature after a predetermined period of time passes so that a degree of vacuum inside the rotary chamber stably reach an ultra high vacuum from atmospheric pressure.

However, a method of detecting the temperature of the heater instead of the temperature of the oil and controlling that temperature suggested in the Patent Document 2 tends to be influenced by a flow of air (wind) in the periphery of the heater and a temperature of that air easier than a method of measuring the temperature of the oil inside the boiler to be originally controlled and controlling heater power with using a numerical value of the measurement, and therefore, correlation between the oil temperature and the heater temperature may be broken in some cases due to fluctuations in the airflow volume and the air temperature. Moreover, in the case of the cartridge heater, the temperature of the heating unit cannot be directly measured, and temperature measurement is performed by a heat detecting member such as a thermistor placed on a flange part provided outside a boiler of the cartridge heater, and therefore, an actual heater temperature and a temperature of the flange part also tend to be influenced by the airflow volume and the air temperature, and their correlation may also be broken.

Still further, as described above, the oil inside the oil diffusion pump is heated by the boiler, and is evaporated and vaporized to become the oil molecules, and the oil molecules are injected from the jet stream generating unit, hit a housing of the oil diffusion pump, and are cooled. However, there is no extreme large difference between a pressure inside the pump and a pressure inside a pipe connected to the pump in vicinity of a suction port of the oil diffusion pump, and therefore, the oil molecules inside the oil diffusion pump may be diffused in a direction of the pipe, or the part thereof which has not been cooled may be exhausted from the outlet of the oil diffusion pump to the auxiliary vacuum pump. Accordingly, the amount of the oil inside the boiler is decreased in the long term, and therefore, it is required to add or replace the oil.

More particularly, in the case of the oil diffusion pump used in the centrifuge as different from a general vacuum machine, a blocking mechanism such as a valve is often not provided between the rotary chamber (the rotor chamber) and the oil diffusion pump because of low cost fabrication, and therefore, the decrease in the amount of the oil inside the boiler due to a back diffusion phenomenon of the oil molecules cannot be avoided.

In the case of the centrifuge, if the amount of the oil in the oil diffusion pump is decreased and a necessary high degree of vacuum cannot be obtained, the rotor cannot be rotated at high speed, and therefore, the control of the amount of the oil in the oil diffusion pump is important. However, in a normal centrifuge, the oil diffusion pump is provided below the centrifuge or below back side of the same, and therefore, even if an observation window generally used for controlling the amount of the oil is provided to the boiler unit, the control of the amount of the oil by that is difficult.

Still further, as a need for the centrifuge, it is desired, prior to appearance of a state that the necessary vacuum capability from the oil diffusion pump cannot be obtained, to make an announcement of a possibility of the state to a user.

A preferred aim of the present invention is to provide a centrifuge without the above-described demerits of the conventional technique in which a degree of vacuum inside a rotary chamber where a rotor is placed can be stably maintained and in which it can be detected whether a necessary amount of oil in a used oil diffusion pump exists or not.

According to an aspect of the present invention, a centrifuge includes: a rotary chamber; a rotor placed inside the rotary chamber to hold a test sample and perform the centrifuging on the test sample; a driving unit for rotating the rotor; and a vacuum pump machine configured of an auxiliary vacuum pump and an oil diffusion pump for exhausting gas inside the rotary chamber to outside, and the centrifuge is provided with a detecting unit serving as a unit for detecting an oil temperature inside a boiler in which oil of the oil diffusion pump is stored and a unit for detecting an oil surface.

Note that any combination of the above-described components and any conversion of the representation of the present invention among a method, a system, and others are also effective as the aspect of the present invention.

According to the centrifuge of the present invention, when a vacuum pump machine configured of an auxiliary vacuum pump and an oil diffusion pump is used, the oil temperature and the oil surface inside the boiler in which the oil of the oil diffusion pump is stored are detected, and therefore, the oil temperature can be controlled easier than that in a structure in which a temperature of a heater for heating the oil inside the boiler is detected, so as not to be influenced by a temperature and an amount of airflow in periphery of the oil diffusion pump, more particularly, the boiler. Also, by figuring out a timing of the oil addition/replacement from the detection of the oil surface of the oil diffusion pump, lack of the vacuum capability due to shortage of the oil in the oil diffusion pump can be prevented. That is, the degree of vacuum inside the rotary chamber in which the rotor is placed can be stably maintained. Still further, both of the detection of the oil temperature and the detection of the oil surface are served by one detecting unit, and therefore, the structure can be simplified.

BRIEF DESCRIPTIONS OF THE DRAWINGS

DESCRIPTIONS OF THE PREFERRED EMBODIMENTS

Hereinafter, a preferable embodiment of the present invention will be described in detail below with reference to the drawings. Note that the same or similar components, members, processes, and others illustrated in each drawing are denoted by the same reference symbols, and repetitive explanations thereof are appropriately omitted. Also, the embodiment does not restrict the present invention and is merely exemplified, and all features and combinations thereof described in the embodiment are not always essential to the present invention.

Figure 1:
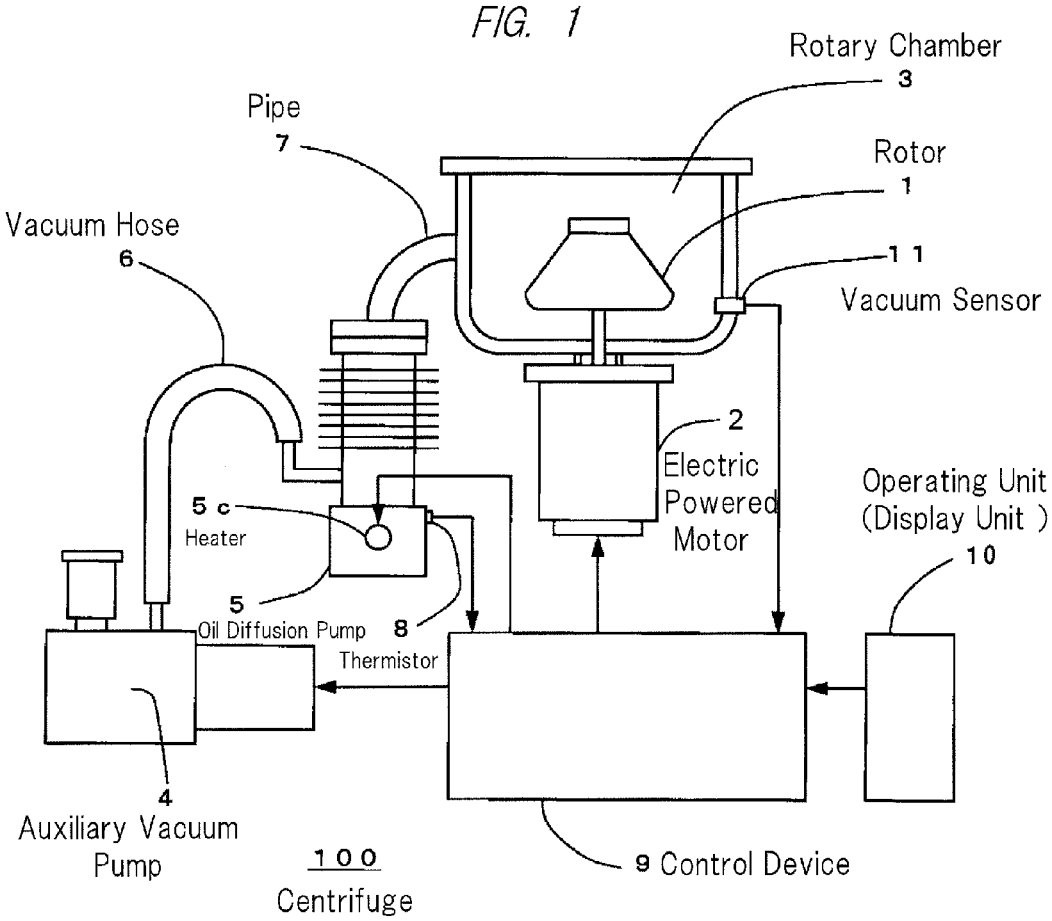
FIG. 1 is a configuration diagram of a centrifuge according to an embodiment of the present invention.
Figure 2:
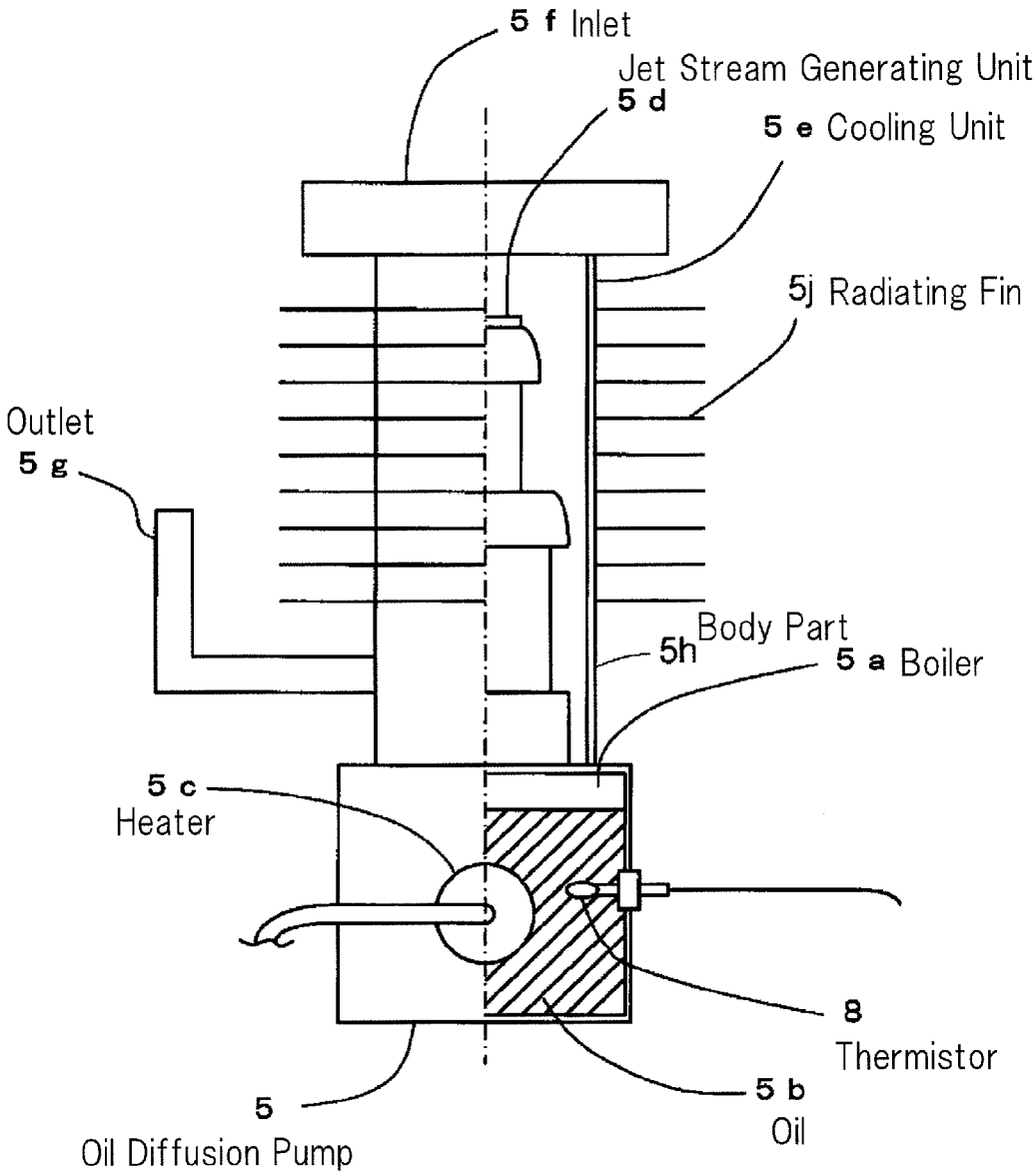
FIG. 2 is a partial cross-sectional configuration diagram of an oil diffusion pump of the centrifuge.
Figure 3:
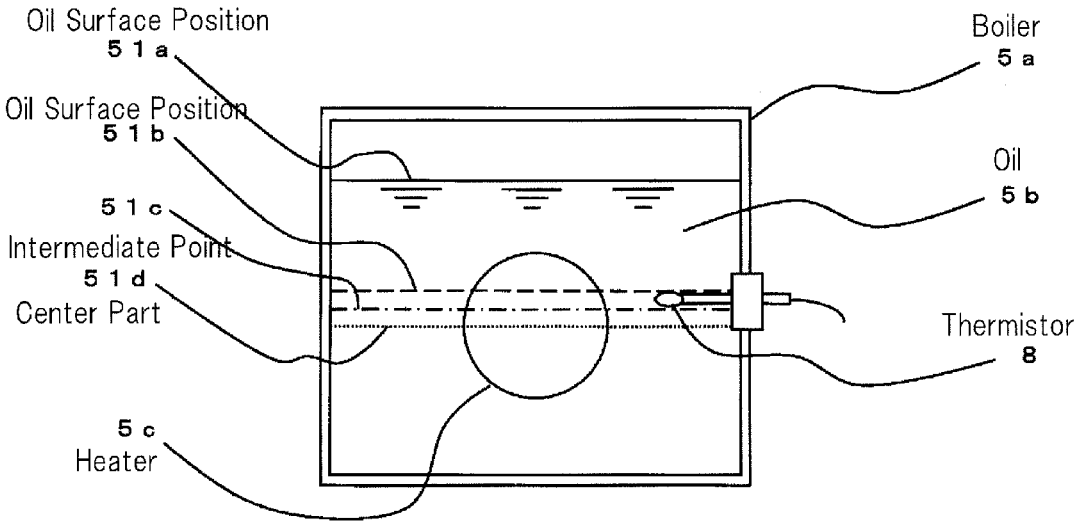
FIG. 3 is a cross-sectional diagram illustrating arrangement of a heater and a thermistor and a position of an oil surface inside a boiler in the oil diffusion pump.

FIG. 1 illustrates a centrifuge according to an embodiment of the present invention, FIG. 2 illustrates its oil diffusion pump unit, and FIG. 3 illustrates a boiler unit in the oil diffusion pump. A centrifuge 100 includes: a rotor 1 to which a test sample stored in a tube or others is attached (held) for centrifuging; an electric-powered motor 2 serving as a driving unit for rotating and driving the rotor 1 at high speed; a rotary chamber 3 in which the rotor 1 is placed; an auxiliary vacuum pump 4; and an oil diffusion pump 5. The auxiliary vacuum pump 4 and the oil diffusion pump 5 are connected in series to each other via a vacuum hose 6, a pipe 7 connects between the rotary chamber 3 and the oil diffusion pump 5, and the auxiliary vacuum pump 4 and the oil diffusion pump 5 configure a vacuum pump machine for reducing a pressure inside the rotary chamber 3 to a high vacuum state.

The auxiliary vacuum pump 4 is an oil rotary vacuum pump, a dry scroll vacuum pump, or others for reducing the pressure in the rotary chamber 3 to a medium vacuum state whose pressure is, for example, 20 pascals, and the oil diffusion pump 5 is provided to reduce the pressure in the rotary chamber 3 to a high vacuum state. After the pressure inside the rotary chamber 3 is reduced to the medium vacuum state by the auxiliary vacuum pump 4, and then, the oil diffusion pump 5 starts an air exhausting operation, so that a higher vacuum state can be achieved.

The centrifuge 100 further includes: a thermistor 8 serving as a detecting unit for both of oil temperature detection and oil surface detection; a control device 9; an operating unit 10; and a vacuum sensor 11. A first function of the thermistor 8 is to detect a temperature of oil 5*b* inside a boiler 5*a* of the oil diffusion pump 5. By the detection of the temperature of the oil 5*b*, power of a heater 5*c* inside the oil diffusion pump 5 is controlled via the control device 9. A second function of the thermistor 8 is to detect an oil surface of the oil 5*b* inside the boiler 5*a* (which will be described later with reference to FIG. 3 and following diagrams). The control device 9 controls rotational driving of the rotor 1, controls driving and temperatures of the auxiliary vacuum pump 4 and the oil diffusion pump 5, calculates values of the temperature and the oil surface of the oil 5*b* based on a signal from the thermistor 8, and performs other operations. The operating unit 10 functions as an input device for inputting, starting, and stopping an operating condition and also as a display/announcement device for various types of information (including information related to the oil surface and instruction information indicating the oil supply). The vacuum sensor 11 detects a vacuum pressure in the rotary chamber 3, and the control device 9 calculates a vacuum pressure in the rotary chamber 3 based on a signal from the vacuum sensor 11 to use the vacuum pressure as information for the vacuum standby and the vacuum start.

FIG. 2 is a partial cross-sectional configuration diagram of the oil diffusion pump 5 of the centrifuge 100 illustrated in FIG. 1, and the oil diffusion pump 5 includes: the boiler 5*a*; the heater 5*c*; a jet stream generating unit 5*d*; a cooling unit 5*e*; an inlet 5*f*; and an outlet 5*g*. The heater 5*c* heats the boiler 5*a*, and the boiler 5*a* heats the oil 5*b* stored therein. The oil molecules heated by the boiler 5*a* to be evaporated and vaporized go up through a center part of the jet stream generating unit 5*d*, and are powerfully injected downward from a peripheral part thereof. The oil molecules injected at a high speed from the jet stream generating unit 5*d* hit a wall surface of the cooling unit 5*e*, and are cooled and liquefied. At this time, gas molecules in periphery of the oil molecules are blown away by the oil molecules, and are compressed downward. Note that the inlet 5*f* is connected to the rotary chamber 3, and the outlet 5*g* is connected to the auxiliary vacuum pump 4.

When the vacuum pump machine configured of the auxiliary vacuum pump 4 and the oil diffusion pump 5 starts their operations, the pressure inside the rotary chamber 3 starts to be reduced by the auxiliary vacuum pump 4 from the atmospheric pressure. At the same time, the heater 5*c* of the oil diffusion pump 5 starts heating the oil 5*b* by using a cartridge heater or others with a high thermal conductivity to the oil 5*b*, and then, the pressure in the rotary chamber 3 is reduced by the oil diffusion pump 5 to the high vacuum state.

A boiling point of the oil 5*b* for the oil diffusion pump which is stored inside the boiler 5*a* depends on a type thereof, and is, for example, 215° C. The heater 5*c* for heating the oil 5*b* is of a type, for example, in which a heater is provided in oil as a cartridge heater, with a high thermal conductivity from the heater 5*c* to the oil 5*b*, which results in increase in the temperature of the oil in a short period of time. The cooling unit 5*e* includes: a body part 5*h*; and a radiating fin 5*j* provided on an outer periphery of this body part.

Figure 4:
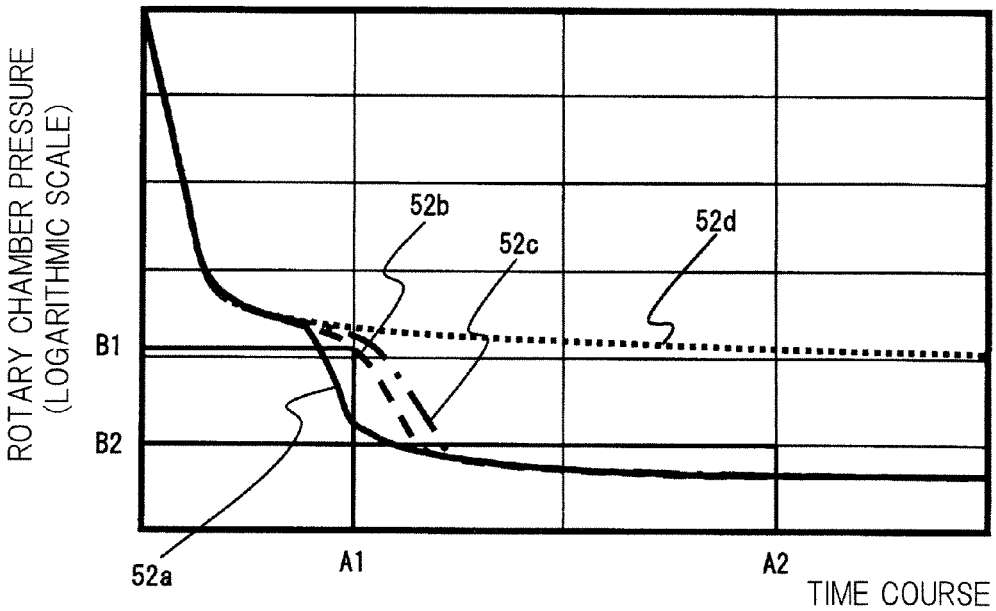
FIG. 4 is a graph illustrating an example of time variation in a vacuum pressure of a rotary chamber at a predetermined oil surface.

The operation of the centrifuge according to the embodiment of the present invention will be explained with reference to the cross-sectional diagram (FIG. 3) illustrating the arrangement of the heater 5*c* and the thermistor 8 inside the boiler 5*a* and the position of the oil surface and a graph (FIG. 4) illustrating time variation in the vacuum pressure in the rotary chamber 3 at the oil surface illustrated in FIG. 3.

In FIG. 3, the oil 5*b* for the oil diffusion pump, for example, containing silicon as a main component and having a boiling point of 215° C. is stored inside the boiler 5*a*. At a center part of the boiler 5*a*, the cartridge heater whose shape is, for example, a bar shape is provided as the heater 5*c*. Also, from a side surface of the boiler 5*a*, the thermistor 8 serving as a temperature sensor is provided so as to protrude. The thermistor 8 is obtained by encapsulating a heat-resistant thermistor chip in heat-resistant glass to be integrated with a ceramic tablet, so that a heat resistance thereof is improved up to 500° C.

Upon the start of the usage of the oil 5*b* for the oil diffusion pump, the oil surface is at a position 51*a* at which the heater 5*c* can sufficiently soak therein. When the oil surface is at the position 51*a*, if the pressure in the rotary chamber 3 of the centrifuge 100 is reduced to the vacuum state by using the oil diffusion pump 5, a capability is achieved as indicated by a solid line 52*a* in FIG. 4 so that the pressure becomes a predetermined pressure "B1" or lower within predetermined time "A1" and further becomes a predetermined pressure "B2" or lower within predetermined time "A2". Here, a relation between A1 and B1 and a relation between A2 and 32 are represented by values obtained from a vacuum exhaust capability of the rotary chamber 3 required for showing a sufficient centrifuge capability of the centrifuge 100. Then, the amount of the oil is gradually decreased due to the oil diffusion phenomenon under the vacuum state and suction by the auxiliary vacuum pump 4, and the oil surface is lowered down to a position 51*b* illustrated in FIG. 3. When the oil surface is at the position 51*b*, a capability is achieved as indicated by a broken line 52*b* in FIG. 4 so that the pressure reaches the predetermined pressure B1 within the predetermined time A1. That is, the position 51*b* is an oil level which is required at minimum. In the amount of the oil at this time, the capability that the pressure becomes the pressure B2 or lower within the predetermined time A2 is achieved. When the usage of the oil diffusion pump 5 further continues, the amount of the oil is further decreased, and the oil surface reaches at an intermediate point 51*c* between a center part 51*d* and the above-described position 51*b* in the heater 5*c*. In the amount of the oil at this time, the performance of the oil diffusion pump 5 does not allow the capability that the pressure becomes the predetermined pressure B1 or lower within the predetermined time A1. When the amount of the oil is further decreased to reach close to the position 51*d* illustrated in FIG. 3, the vacuum exhaust capability of the oil diffusion pump 5 is as indicated by a dotted line 52*d* in FIG. 4, and does not allow even the capability that the pressure becomes the predetermined pressure B2 or lower within the predetermined time A2.

Next, in a case that the thermistor 8 is placed inside the oil 5*b* illustrated in FIG. 3 at a position in contact with the oil surface position 51*b*, temperature variation in the thermistor 8 in accordance with the oil level (the detection of the oil surface by using the thermistor 8) will be described. First, in a state that the heater 5*c* of the oil diffusion pump 5 is not energized so as not to heat the oil 5*b*, a predetermined current for self-heating, for example, a current of 30 mA, is carried through the thermistor 8. As described above, in the state that the thermistor 8 totally soaks in the oil 5*b*, heat generated from the self-heating of the thermistor 8 is absorbed by the surrounding oil 5*b*, and therefore, the temperature of the thermistor 8 is hardly increased. Also, when the oil surface is at the oil surface position 51*b* or lower so that a part of the thermistor 8 appears above the oil surface, a heat-radiation area to the oil 5*b* is decreased, and therefore, the temperature of the thermistor 8 is increased up to the temperature of the oil 5*b* or higher, although not being increased up to a self-heating temperature (150° C.). Then, when most of the thermistor 8 appears above the oil surface, the heat absorbing part disappears, and therefore, the temperature of the thermistor 8 is increased up to nearly 150° C. Accordingly, by carrying the current of 30 mA through the thermistor 8 prior to the heating by the heater 5*c* and measuring variation in a resistance value due to the temperature variation, it can be determined whether the thermistor 8 totally soaks in the oil 5*b*, whether a part thereof appears above (partially exposed from) the oil surface, or whether totally appears above (entirely exposed from) the oil surface.

Figure 5:
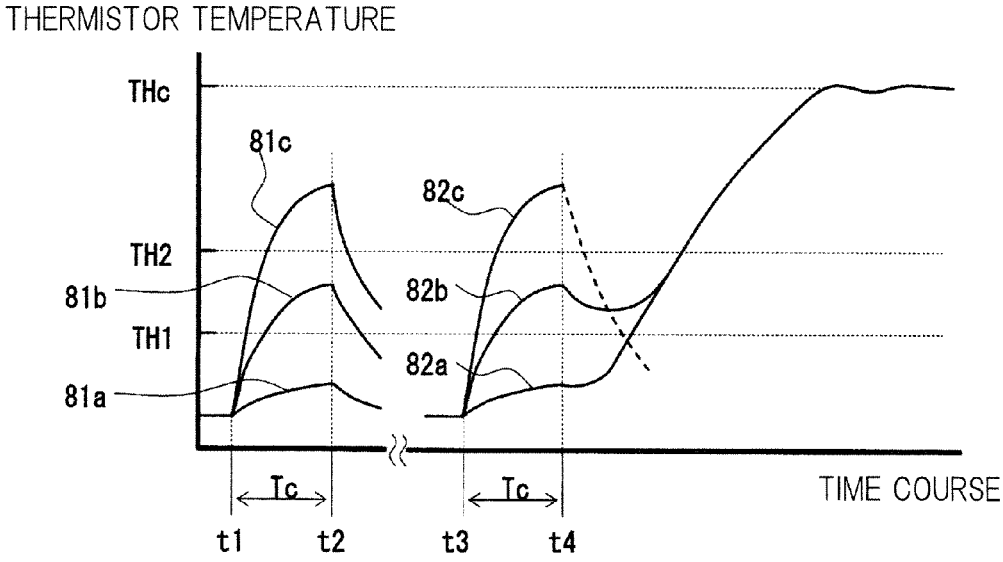
FIG. 5 is a graph illustrating an example of temperature variation in the thermistor in accordance with different oil levels.

FIG. 5 is a graph illustrating an example of the temperature variation in the thermistor 8. At time "t1" at which the oil diffusion pump 5 is not operated so that the temperature of the oil 5*b* is close to room temperature, a predetermined current for the self-heating of, for example, 30 mA is carried through the thermistor 8 for only predetermined time "Tc" for the self-heating of the thermistor 8, and the temperature of the thermistor at this time is measured. If the thermistor 8 soaks in the oil 5*b*, the heat is absorbed by the oil 5*b*, and therefore, the increase in the temperature is small as indicated by temperature variation 81*a*. However, if a part of the thermistor 8 is exposed from the oil 5*b*, the heat absorption by the oil 5*b* is less, and predetermined increase in the temperature as indicated by temperature variation 81*b* appears. Further, if the thermistor 8 is totally exposed from the oil 5*b*, larger temperature variation as indicated by temperature variation 81*c* occurs.

Accordingly, the temperature of the thermistor 8 at time t2 at which the predetermined time Tc has passed from the time t1, that is, a thermistor temperature at time when a part of the thermistor 8 starts to be exposed from the oil 5*b*, is defined as "TH1". Also, a thermistor temperature at time when the oil surface is lowered down to a level at which the oil diffusion pump 5 cannot maintain the necessary air exhaust capability is defined as "TH2". At time when the thermistor temperature exceeds the predetermined temperature TH1, the oil 5*b* starts decreasing, and therefore, an announcement for encouraging a user to supply the oil 5*b* can be provided. Also, at time when the thermistor temperature exceeds TH2, an announcement that the centrifuge 100 cannot achieve the necessary vacuum exhaustion capability can be provided with an alarm message or others. The above-described announcements can be provided by, for example, display, announcement with sound, or others by the operating unit 10 via the control device 9 that calculates the temperature of the thermistor 8 from a resistance value thereof.

The above-described oil surface detection may be preferably performed, for example, at time when the centrifuge 100 is powered on, at predetermined time interval (for example, every thirty minutes) during the stop of the centrifuge 100 (when the heater 5*c* is not energized), at time when the vacuuming starts (simultaneously with the start of energization of the heater 5*c*), or others.

In illustration after time "t3" in FIG. 5, an example of temperature variation in the case that the oil surface detection is performed at the time when the vacuuming starts (simultaneously with the start of energization of the heater 5*c*) is illustrated. When the temperature of the thermistor 8 is sufficiently low at the time t3 when the operation starts, the carrying of the current for the self-heating (for example, 30 mA) through the thermistor 8 starts. When the thermistor temperature exceeds TH2 as indicated in the temperature variation 82*c* at time "t4" when the predetermined time Tc has passed, the state that the oil diffusion pump 5 cannot achieve the air exhaustion capability is shown with the alarm message or others, so that the centrifuging is interrupted. If the temperature variation 82*b* is observed, the announcement for encouraging the user to supply the oil 5*b* (the display, the announcement with sound, or others by the operating unit 10) is provided, and then, the centrifuging continues. If the temperature variation 82*a* is observed, normal centrifuging is performed. Further, after passing the time t4, the carrying of the current for the self-heating through the thermistor 8 is stopped, and then, the oil temperature measurement is performed by using variation in the resistance based on the temperature of the thermistor 8. The temperature of the oil 5*b* during the centrifuging is maintained close to a predetermined temperature "THc" based on the temperature detected from the thermistor 8.

Here, while the predetermined time Tc differs depending on a size of the thermistor 8, the resistance value thereof, and others, the predetermined time Tc is about 10 to 30 seconds. Also, the predetermined temperature TH1 is, for example, 70° C., the TH2 is, for example, 120° C., and the THc is, for example, 215° C.

Figure 6:
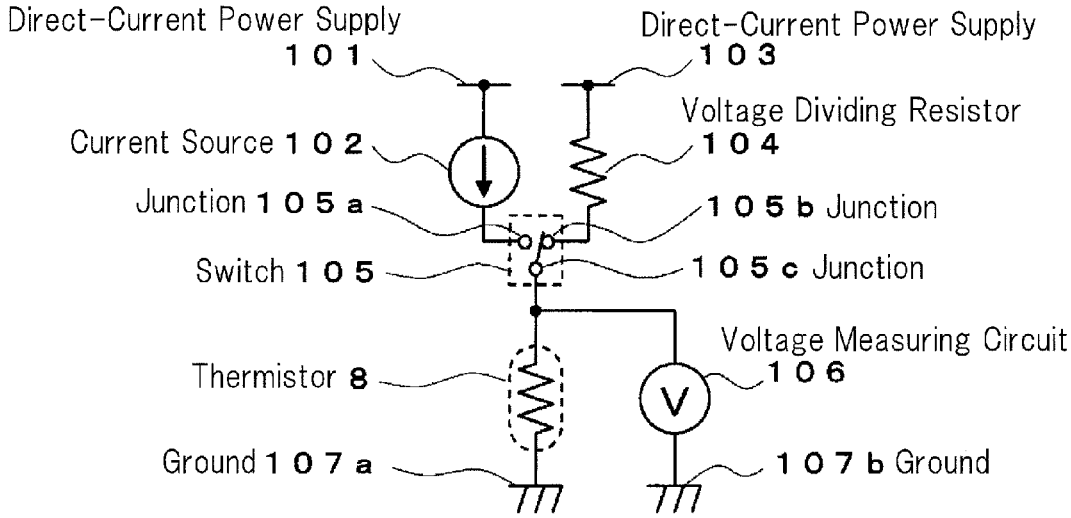
FIG. 6 is a circuit diagram illustrating an example of a circuit for oil temperature measurement and oil surface detection by the thermistor.

FIG. 6 illustrates an example of a circuit for the oil temperature measurement and the oil surface detection by the thermistor 8. This circuit is embedded inside the control device 9 in FIG. 1. In the normal oil temperature measurement, a voltage dividing resistor 104 and the thermistor 8 are connected in series between a direct-current power supply 103 and a ground 107*a* via a switch 105 which is set so as to connect between junctions 105*c* and 105*b*. And, a voltage generated between terminals of the thermistor 8 is measured by a voltage measuring circuit 106 to obtain a voltage division ratio, so that the resistance value of the thermistor 8 is obtained, and can be converted to the temperature. The direct-current power supply 103 has, for example, a direct current of 5 V with high accuracy, and the voltage dividing resistor 104 has a resistance value of, for example, 15 kohm, which is sufficiently large to suppress the self-heating of the thermistor 8.

In the detection of the oil surface, the switch 105 is switched so that junctions 105*c* and 105*a* are connected to each other, and the predetermined current for the self-heating (a current larger than that in the oil temperature measurement) is carried from a current source 102 connected to a direct-current power supply 101 to the thermistor 8 for the self-heating. Also at this time, a voltage in correlation with the temperature of the thermistor 8 is generated between the terminals of the thermistor 8. Therefore, by measuring this voltage by the voltage measurement circuit 106, the resistance value of the thermistor 8 can be calculated from an already-known current value of the current source 102 and the measured voltage value, so that the temperature of the thermistor 8 can be calculated.

In the above-described manner, the temperature of the heater 5*c* for the oil heating can be controlled by the thermistor 8 when the thermistor 8 soaks inside the oil 5*b* at the oil surface at which the oil is stored so as to allow the capability (indicated by the broken line 52*b* in FIG. 4) of the oil diffusion pump 5 that the pressure reaches the predetermined pressure B1 within the predetermined time A1 and becomes the predetermined pressure B2 or lower within the predetermined time A2, that is, at the oil surface position 51*b* illustrated in FIG. 3, and besides, when a part of the thermistor 8 is placed at the position in contact with the oil surface position 51*b*. Also, by carrying the current of, for example, 30 mA, larger than that in the heating control, through the thermistor 8 prior to the energization of the heater 5*c*, information about a degree of the exposure of the thermistor 8 from the oil 5*b* can be obtained from the variation in the resistance value. From an announcement of this information by display or sound in the operating unit 10 or others in FIG. 1, the user of the centrifuge 100 can obtain information about the oil overage/shortage in the oil diffusion pump 5, so that maintenance can be performed before the vacuum capability of the centrifuge 100 is decreased.

According to the present embodiment, the following effects can be achieved.

(1) When the vacuum pump machine configured of the auxiliary vacuum pump 4 and the oil diffusion pump 5 is used, the thermistor 8 is provided inside the boiler 5*a* as the detecting unit for detecting the oil temperature and the oil surface inside the boiler 5*a* of the oil diffusion pump 5, and the power of the heater 5*c* is adjusted with the temperature detected by this thermistor 8, so that the degree of vacuum inside the rotary chamber can be stably reduced from the atmospheric pressure to the high vacuum state. Also, at time when the heater 5*c* inside the boiler 5*a* does not heat (for example, before the heating start) or at the same time as the heating start, the current larger than that in the temperature detection is carried through the thermistor 8 for the self-heating, so that the determination result from the variation in the resistance value indicating whether the oil 5*b* exists or not at the position where the thermistor 8 is placed can be displayed in the operating unit 10 or prediction of the amount of the oil therefrom can be announced to the user of the centrifuge. Therefore, the lack of the vacuum capability due to the oil shortage in the oil diffusion pump 5 can be prevented, and, eventually, the degree of vacuum inside the rotary chamber 3 in which the rotor 1 is placed can be stably maintained.

(2) Since the oil temperature inside the boiler 5*a* is detected by the thermistor 8, and therefore, compared to the configuration in which the heater temperature for heating the oil inside the boiler 5*a* is detected, the oil temperature can be controlled without the influence of the temperature and the airflow volume of the oil diffusion pump 5, more particularly, in the periphery of the boiler 5*a*.

(3) Both of the oil temperature detection and the oil surface detection can be performed by the thermistor 8 as one detecting unit, and therefore, the configuration can be simplified.

(4) When a part of the thermistor 8 is exposed from the oil surface 51*b* which is the oil level required at minimum, the instruction information indicating the oil supply is issued, and besides, the operation of the centrifuging continues. When the thermistor 8 is totally exposed from the oil surface 51*b*, the interruption of the operation of the centrifuging is operated by the control device 9, so that the increase in the temperatures of the rotor 1 and the test sample held by the rotor due to the windage loss can be prevented before it occurs.

In the foregoing, the present invention has been explained by exemplifying the present embodiment. However, it could be understood by those who skilled in the art that various modification of each component and each process of the present embodiment can be made within the scope of claims. Hereinafter, the modification examples will be described.

In FIG. 6, the current source 102 and the voltage dividing resistor 104 are switched. However, in the present invention, a current source or a voltage dividing resistor can be used for both of the oil temperature measurement and the oil surface detection as long as an appropriate constant is selected. Also, as the thermistor 8, both of a positive temperature coefficient thermistor and a negative temperature coefficient thermistor can be used.

What is claimed is:

1. A centrifuge comprising:

a rotary chamber;

a rotor placed inside the rotary chamber to hold a test sample and perform centrifuging on the test sample;

a driving unit for rotating the rotor; and a vacuum pump machine configured of an auxiliary vacuum pump and an oil diffusion pump for exhausting gas inside the rotary chamber to outside, a detecting unit serving as both of a unit for detecting a temperature of oil stored inside a boiler of the oil diffusion pump and a unit for detecting an oil surface provided inside the boiler.

2. The centrifuge according to claim 1, wherein:

the detecting unit is provided at a position at which the detecting unit is not exposed from an oil surface when an oil level is at a required minimum level and is exposed from the oil surface when the oil level is lower than the required minimum level.

3. The centrifuge according to claim 2, wherein:

the detecting unit is a thermistor, and a current is carried through the thermistor for predetermined time for self-heating, and the oil surface is detected from a temperature of the thermistor after carrying the current therethrough for the predetermined time.

4. The centrifuge according to claim 2, wherein:

when a part of the detecting unit is exposed from the oil surface, instruction information indicating oil supply is issued, and besides, an operation of the centrifuging continues, and when an entire part of the detecting unit is exposed from the oil surface, the operation of the centrifuging is interrupted.

5. The centrifuge according to claim 1, wherein:

when the oil surface is at a predetermined oil level or lower as a result of the detection of the oil surface inside the boiler, information indicating a state that the oil is at the predetermined oil level or lower is displayed by a device including a display function.

* * * * *